US006050843A

United States Patent [19]

Adriaenssens et al.

[11] Patent Number: 6,050,843

[45] Date of Patent: Apr. 18, 2000

[54] CROSSTALK CANCELING 110 INDEX STRIP AND WIRING BLOCK

[75] Inventors: Luc Walter Adriaenssens, Red Bank; Goalm M. Choudhury, Warren; Theodore Alan Conorich, Parsippany Township, Morris County; Michael Gregory German, Secaucus, all of N.J.; Amid Ihsan Hashim, West Hartford, Conn.; Bryan S. Moffitt, Red Bank, N.J.

[73] Assignee: Lucent Technologies Inc., Murray Hill, N.J.

[21] Appl. No.: 08/903,973

[22] Filed: Jul. 31, 1997

[51] Int. Cl.[7] ..... H01R 4/24

[52] U.S. Cl. ..... 439/404

[58] Field of Search ..... 439/404, 405, 439/941

[56] References Cited

U.S. PATENT DOCUMENTS 5,326,284 7/1994 Bohbot ..... 439/941
5,403,200 4/1995 Chen ..... 439/941
5,431,584 7/1995 Ferry ..... 439/941
5,476,388 12/1995 Rutkowski ..... 439/404
5,791,943 8/1998 Lo ..... 439/941

*Primary Examiner*—Khiem Nguyen
*Assistant Examiner*—Javaid Nasri
*Attorney, Agent, or Firm*—Gibbons, Del Deo, Dolan, Griffinger & Vecchione

[57] ABSTRACT

A connector block for electrically cross-connecting two sets of conductors. The connector block has a wiring block with a plurality of insulation displacement contacts for mating with a first set of TIP conductors and a second set of RING conductors. An index strip made from dielectric material, is provided for securing the TIP and RING conductors against their respective contacts, wherein the index strip includes a plurality of C-shaped metal clips which provide crosstalk compensation in the connector block thereby providing the connector block with a worst conductor pair to conductor pair near-end crosstalk loss @100 MHz of better than 55 dB.

14 Claims, 3 Drawing Sheets

CROSSTALK CANCELING 110 INDEX STRIP AND WIRING BLOCK

FIELD OF THE INVENTION

The present invention relates to connector systems for electrically cross-connecting two sets of conductors and more specifically, to a connector block for use in communications applications, including means for providing crosstalk compensation in the connector block.

BACKGROUND OF THE INVENTION

Connector systems comprised of a plug and a connector block having an index strip and a wiring block, are well known in the art and are commercially available from Lucent Technologies as the 110 connector system. The plug and the connector block, are typically constructed with a plurality of insulation displacement contacts (IDC contacts). In the connector block, the IDC contacts mate with a first set of conductors (typically the building's cable conductors), the conductors being held in place or "indexed" by a plurality of teeth provided on the index strip which lies above the wiring block. A corresponding plurality of spaced-apart teeth carried by the plug serve to index a second set of conductors to be cross-connected through the IDC contacts of the connector block to the first set of conductors.

Such a connector block exhibits a worst pair to pair near-end crosstalk NEXT loss @ 100 MHz of only 46 dB when test leads are punched down directly on the connector block and only 49 dB when an exiting 110 category 5 plug is mated with the connector block.

Accordingly, there is a need for connector block with improved near-end crosstalk performance which is compatible with existing wiring blocks and patch cords.

SUMMARY OF THE INVENTION

In accordance with the present invention, there is provided a connector block for electrically cross-connecting two sets of conductors. The connector block comprises a plurality of contacts for mating with a first set of conductors and a second set of conductors. An index strip is provided for securing the first and second sets of conductors against their respective contacts, wherein the index strip includes means for providing crosstalk compensation in the connector block.

The crosstalk compensation means can include a plurality of conductive members, each of which electrically couple to a respective one of the contacts when the index strip is punched down over the contacts. This arrangement increases capacitive coupling between adjacent pairs of like conductors from one of the first and second set of conductors which opposes and cancels capacitive coupling between adjacent pairs of unlike conductors one from each respective first and second set of conductors.

In one embodiment of the present invention each one of the conductive members comprises a metal clip disposed in the index strip, the metal clip being preferably C-shaped.

Another aspect of the present invention, involves a wiring block which includes the plurality of contacts.

In a preferred embodiment of the present invention, the contacts are insulation displacement contacts.

In another embodiment of the present invention, the wiring block includes said crosstalk compensation means.

DESCRIPTION OF THE DRAWINGS

A more complete understanding of the present invention may be obtained from consideration of the following description in conjunction with the drawings in which.

DETAILED DESCRIPTION OF VARIOUS ILLUSTRATIVE EMBODIMENTS

Figure 1:
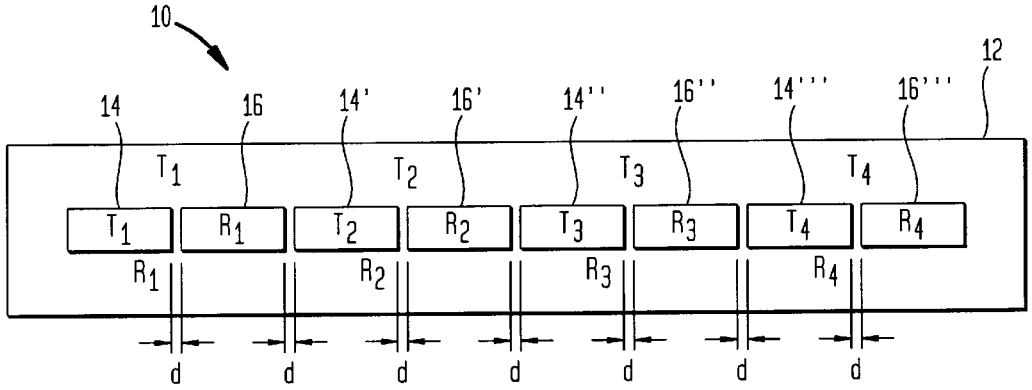
FIG. 1 (PRIOR ART)
FIG. 1 is a bottom plan view of a prior art connector block.

Referring to FIG. 1, a bottom plan view of a typical prior art 110 connector system is shown and denoted by numeral 10. The connector block 10 includes a plurality of insulation displacement contacts (IDC contacts) 14, 14', 14", and 14'" for mating with respective TIP conductors T1–T4 and a plurality of IDC contacts 16, 16', 16", 16'" for mating with respective RING conductors R1–R4. The IDC contacts are spaced apart and arranged in an in line manner with the IDC TIP contacts alternating with the IDC RING contacts. Each IDC contact is spaced from an adjacent contact IDC contact by a distance d. The TIP and RING conductors are held in place by an index strip 12. The capacitive coupling C between like conductors (TIP to TIP) of adjacent pairs and the capacitive coupling between unlike conductors (TIP to RING or RING to TIP) of adjacent pairs, can be determined using the following equation:

$$C=AKV/d$$

where A is a constant which is proportional to the area of the IDC blade, K is the dielectric constant of the material between the pairs and V is the voltage applied to the IDC contact.

Accordingly, the capacitive coupling between T1 and T2 is equal to −AK/2d; the capacitive coupling between T1 and R2 is equal +AK/3d; the capacitive coupling between R1 and T2 is equal to −AK/d; and the capacitive coupling between R1 and R2 is equal to −AK/2d. Then the net capacitive coupling on T2 equals −AK/2=−AK/3−AK/6, and the net capacitive coupling on R2 equals −AK/6=−AK/3+AK/6. Consequently, the net capacitive coupling from pair 1 to pair 2 is AK/3 longitudinal and AK/3 metallic.

If NEXT=46 dB @100 MHz then, LCL=46 dB@100 MHz. Hence, the key to improved connector performance both NEXT and LCL, lies in providing the same total effective coupling from the TIP and RING of one pair to TIP and RING of the other pair.

Figure 2:
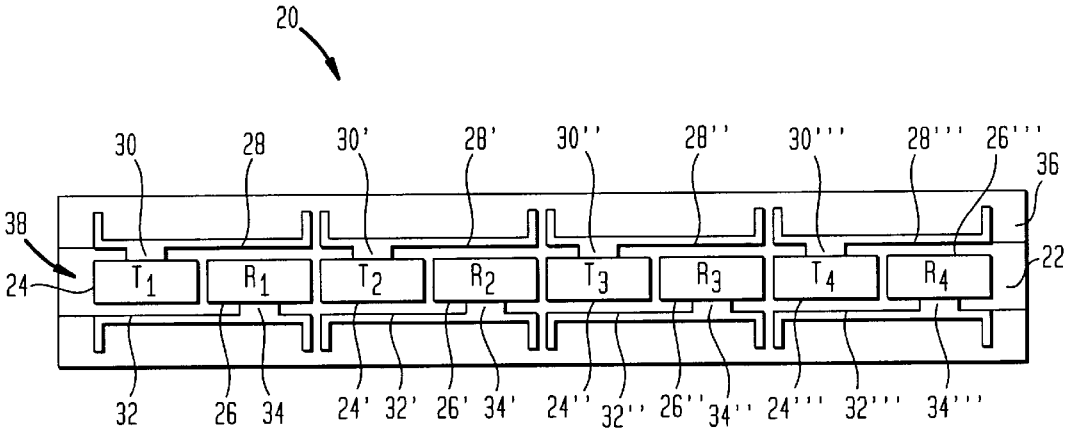
FIG. 2 is a top plan view of an exemplary embodiment of a connector block according to the present invention.

Referring now to FIG. 2, a top plan view of a connector block according to the present invention is shown and denoted by numeral 20. The connector block 20 comprises a wiring block 22 and a detachable index strip 36. The wiring block includes an alternating, in line arrangement of TIP and RING IDC contacts 24, 26, 24', 26', 24", 26", 24'" and 26'". The index strip 36 defines an open slot 38 which allows the TIP and RING IDC contacts to extend therethrough. In order to substantially improve the near-end crosstalk performance of the connector block 20 to achieve better than 55 dB worst conductor pair to conductor pair NEXT loss @100 MHz and substantially comparable LCL, a plurality of C-shaped metal clips 28, 28', 28", 28'", 32, 32', 32", and 32'" are provided in the index strip. The clips 28, 28', 28", and 28'" are disposed along a first side of the slot 38 adjacent TIP conductors T1, T2, T3, and T4. The clips 32, 32', 32", and 32'" are disposed along a second side of the slot 38 adjacent RING conductors R1, R2, R3, and R4. The metal clips each include respective mating fingers 30, 34, 30', 34', 30", 34", 30'", and 34'", which extend across the slot 38 in the index strip 36 and contact respective TIP and RING IDC contacts 24, 26, 24', 26', 24", 26", 24'" and 26'" when the index strip 36 is punched down over the wiring block 22 as shown in FIG. 2. In other embodiments of the present invention, the metal clips can be provided in both the index strip 36 and the wiring block 22.

Figure 3:
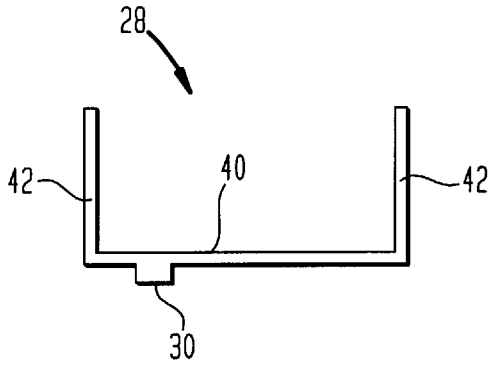
FIG. 3 is enlarged top plan view of one of the C-shaped metal clips shown in FIG. 2.

Referring to FIG. 3, each metal clip (all the metal clips are identically constructed so that only metal clip 28 is described) includes a elongated body 40 and an arm 42 extending from each end thereof. The manner in which the clips are deployed in FIG. 2, increases the capacitive coupling between like conductors of adjacent pairs(TIP to TIP or RING to RING). This operates to oppose the capacitive coupling between unlike conductors of adjacent pairs (TIP to RING or RING to TIP) thus, changing the sign of the net capacitive unbalance in the connector block. One of ordinary skill in the art will recognized that the overlap area, the spacing and the permittivity of the dielectric material between adjacent arms of the clips can be chosen such that the crosstalk due to the resultant capacitive unbalance opposes and cancels the crosstalk due to the inductive coupling between adjacent pairs. This type of cancellation is effective for both NEXT and LCL performance and is not subject to end effects, i.e., pair 4 of one connecting block will cancel pair 1 of adjacent connecting block.

Figure 4A:
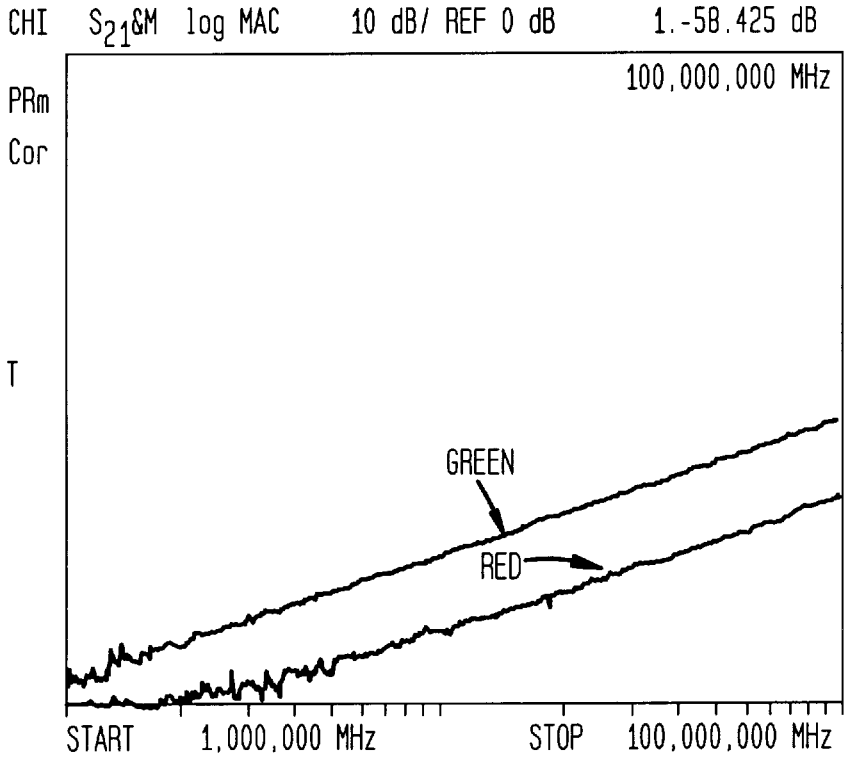
FIGS. 4A and 4B are graphs which compare the worst pair to pair NEXT loss @100 MHz of the connector block of the present invention to the prior art connector block of FIG. 1.
Figure 4B:
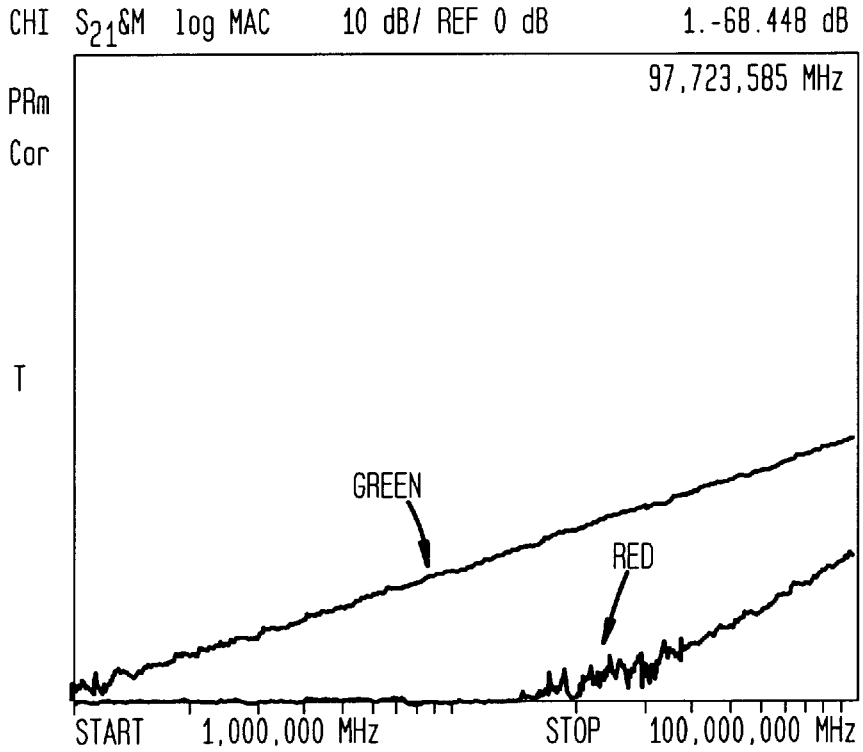

FIGS. 4A and 4B demonstrate the superior near-end crosstalk performance of the connector block of the present invention. In FIG. 4A, a connector block made in accordance with the present invention (red trace) exhibits a worst pair to pair near-end crosstalk NEXT loss @100 MHz of 58 dB when test leads are punched down directly on the connector block compared with only 46 dB for a prior art connector block (green trace) of FIG. 1. Similarly, in FIG. 4B, the connector block of the present invention exhibits a worst pair to pair near-end crosstalk NEXT loss @100 MHz of 68 dB when an existing 110 category 5 plug is mated therewith compared with only 49 dB for the prior art connector block of FIG. 1.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications which come within the scope of the appended claims is reserved.

What is claimed:

1. A connector block for electrically cross-connecting a first set of pairs of conductors to a second set of pairs of conductors, comprising:

a plurality of contacts for mating with the first set of pairs of conductors and the second set of pairs of conductors; and a crosstalk compensation device for balancing capacitive coupling between adjacent pairs of like conductors with capacitive coupling between adjacent pairs of unlike conductors, said compensation device included in the connector block;

wherein said crosstalk compensation device includes a plurality of metal clips, each of which electrically couple to a respective one of said contacts, thereby increasing capacitive coupling between adjacent pairs of like conductors from the first set of pairs of conductors and the second set of pairs of conductors which opposes and cancels capacitive coupling between adjacent pairs of unlike conductors.

2. The connector block according to claim 1, wherein each one of said metal clips is C-shaped.

3. The connector block according to claim 1, further comprising a wiring block which includes said plurality of contacts.

4. The connector block according to claim 3, wherein said wiring block includes said crosstalk compensation device.

5. The connector block according to claim 1, wherein each of said contacts comprises an insulation displacement contact.

6. A connector block for electrically cross-connecting a first set of pairs of conductors to a second set of pairs of conductors, comprising:

a wiring block having a plurality of contacts for mating with the first set of pairs of conductors and the second set of pairs of conductors; and a crosstalk compensation device for balancing capacitive coupling between adjacent pairs of like conductors with capacitive coupling between adjacent pairs of unlike conductors, said compensation device included in the connector block, said compensation device providing said connector block with a worst conductor pair to conductor pair near-end crosstalk loss @100 MHz of better than 55 dB;

wherein said crosstalk compensation device includes a plurality of metal clips disposed along opposing sides of said plurality of contacts, each of said members electrically coupling to a respective one of said contacts, thereby increasing capacitive coupling between adjacent pairs of like conductors from the first set of pairs of conductors and the second set of pairs of conductors which opposes and cancels capacitive coupling between adjacent pairs of unlike conductors.

7. The connector block according to claim 6, wherein each one of said metal clips is C-shaped having an elongated body with opposing ends and an arm extending from each of said ends.

8. The connector block according to claim 7, wherein said elongated body of each clip includes a mating finger which contacts a respective one of said contacts.

9. The connector block according to claim 6, wherein said wiring block includes said crosstalk compensation device.

10. The connector block according to claim 6, wherein each of said contacts comprises an insulation displacement contact.

11. A connector block for electrically cross-connecting a first set of pairs of conductors to a second set of pairs of conductors, comprising:

a wiring block having a plurality of insulation displacement contacts for mating with a first set of TIP conductors and a second set of RING conductors; and a crosstalk compensation device in the connector block for balancing capacitive coupling between adjacent pairs of like conductors with capacitive coupling between adjacent pairs of unlike conductors, said compensation device providing said connector block with a worst conductor pair to conductor pair near-end crosstalk loss @100 Mhz of better than 55 dB;

wherein said crosstalk compensation means includes a plurality of metal clips disposed along opposing sides of said contacts, each of said members electrically coupling to a respective one of said contacts, thereby increasing capacitive coupling between adjacent pairs of TIP to TIP conductors, which opposes and cancels capacitive coupling between adjacent pairs of TIP to RING conductors, and adjacent pairs of ring to TIP conductors.

12. The connector block according to claim 11, wherein each one of said metal clips is C-shaped having an elongated body opposing ends and an arm extending from each of said ends.

13. The connector block to claim 12, wherein said elongated body of each clip includes a mating finger which extends across a slot in an index strip and contacts a respective one of said contacts.

14. The connector block according to claim 11, wherein said wiring block includes said crosstalk compensation device.

* * * * *